US011610494B2

(12) United States Patent
Altus et al.

(10) Patent No.: US 11,610,494 B2
(45) Date of Patent: Mar. 21, 2023

(54) AIRCRAFT FLIGHT ROUTE DETERMINATION SYSTEMS AND METHODS

(71) Applicant: THE BOEING COMPANY, Chicago, IL (US)

(72) Inventors: Stephen S. Altus, Campbell, CA (US); David J. Rynes, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 110 days.

(21) Appl. No.: 17/367,842

(22) Filed: Jul. 6, 2021

(65) Prior Publication Data

US 2021/0343163 A1 Nov. 4, 2021

Related U.S. Application Data

(63) Continuation of application No. 16/276,739, filed on Feb. 15, 2019, now Pat. No. 11,087,631.

(51) Int. Cl.
*G08G 5/00* (2006.01)

(52) U.S. Cl.
CPC ..... *G08G 5/0034* (2013.01)

(58) Field of Classification Search
None
See application file for complete search history.

(56) References Cited

U.S. PATENT DOCUMENTS 8,160,759 B2 * 4/2012 Baker ..... G06Q 10/025 701/16
9,208,457 B2 * 12/2015 Agrawal ..... G08G 5/0034

* cited by examiner

*Primary Examiner* — Todd Melton
(74) *Attorney, Agent, or Firm* — The Small Patent Law Group LLC; Joseph M. Butscher

(57) ABSTRACT

Aircraft flight route determination systems and methods include a route determination control unit that analyzes route data over a selected timeframe to determine one or more efficient routes for aircraft to fly between a first airport and a second airport.

20 Claims, 4 Drawing Sheets

AIRCRAFT FLIGHT ROUTE DETERMINATION SYSTEMS AND METHODS

RELATED APPLICATIONS

This application is a continuation of U.S. patent application Ser. No. 16/276,739, entitled "Aircraft Flight Route Determination Systems and Methods," filed Feb. 15, 2019, now U.S. Pat. No. 11,087,631, which is hereby incorporated by reference in its entirety.

FIELD OF THE DISCLOSURE

Embodiments of the present disclosure generally relate to aircraft flight route determination systems and methods, and more particularly to systems and methods that are configured to determine future routes based on historic route data.

BACKGROUND OF THE DISCLOSURE

Various types of aircraft are used to transport passengers and cargo (both of which may be referred to as payload) between various locations. Each aircraft typically flies between different locations according to a defined flight plan or path. For example, a dispatcher may determine a particular flight plan for an aircraft between two different locations.

During a typical day, an airline schedules numerous flights between different cities. Indeed, numerous flights may be scheduled between a first airport and a second airport. Based on wind and weather conditions, different routes between the cities are flown. For example, based on changing weather conditions and/or the jet stream, a first route to an airport at a first time may differ from a second route to the airport at a second time that differs from the first time for various reasons, such as to avoid certain weather conditions, avoid or reduce flying into headwinds, take advantage of tail winds, and/or the like.

When considering a new route or switching aircraft types on an existing route, airlines need to know how much payload they will be able to carry on that route, how much fuel will be required to carry the payload, and the flight time over a distribution of weather conditions for a defined part of the year. Some airlines fly fixed routes for operational reasons (for example, fixed routes may be pre-stored in a navigational computer on an aircraft for selection by the crew). Certain airlines prefer to generate a reduced set of fixed routes between a pair of airports that increase performance over a full range of days, no matter the wind or weather conditions.

Certain airlines use databases of historical winds between a city-pair (that is, a departure airport and an arrival airport) in a wind percentile analysis. Because the jetstream has a nonlinear effect on the favorability of winds, unfavorable winds everywhere would be if the jetstream occurred simultaneously in every location. However, such winds do not occur at all locations along a route, thereby requiring special handling to prevent the analysis from being overly pessimistic. Accordingly, certain route analysis methods account for the fact that the jetstream is not likely to be on the flight path for an entire Westbound flight or entirely absent from an Eastbound one, but do not sufficiently account for the fact that the route may be advantageously adapted on a particular day of a flight to avoid the jetstream while flying West and follow the jetstream while flying East.

Monte Carlo simulations provide another known route analysis method. Typically, Monte Carlo simulations are either limited to a fixed route or a random variation of ground distance that changes independently from the wind field. As such, Monte Carlo simulations may not accurately model the benefit of live route adaptations on a particular day of flight.

SUMMARY OF THE DISCLOSURE

A need exists for a system and method for determining an efficient route for an aircraft to fly to a destination on any given day.

With such need in mind, certain embodiments of the present disclosure provide an aircraft flight route determination system that includes a route determination control unit that analyzes route data over a selected timeframe to determine one or more efficient routes for aircraft to fly between a first airport and a second airport.

In at least one embodiment, a route database stores the route data. The route determination control unit is in communication with the route database. The route data may include historical records (such as simulated historical records) of routes flown between the first airport and the second airport.

In at least one embodiment, a weather database stores weather data including wind information. The route determination control unit is in communication with the weather database and analyzes the weather data over the selected timeframe to determine the efficient route(s).

The route data may include fuel burn and payload for aircraft that have flown between the first airport and the second airport. The route data may relate to a single airline. Optionally, the route data may relate to a plurality of airlines.

In at least one embodiment, the route determination control unit determines the efficient route(s) based on analysis of fuel burn of the route data. In at least one other embodiment, the route determination control unit determines the efficient route(s) based on analysis of payload of the route data. In at least one other embodiment, the route determination control unit determines the efficient route(s) based on analysis of fuel burn and payload of the route data.

The route determination control unit may identify archived winds for days within the selected timeframe. In at least one embodiment, the route determination control unit determines an efficient route for each day within the selected timeframe. The route determination control unit selects a modal route. The modal route is the route that has been flown the most during the selected timeframe. The route determination control unit determines a most efficient route among the efficient routes for each day within the selected timeframe. The route determination control unit compares the most efficient route with the efficient routes. The route determination control unit then identifies a largest efficiency difference in relation to the most efficient route or day as a largest discrepancy route or day as a largest discrepancy route or day that is added to a set of efficient routes. The route determination control unit determines whether the largest discrepancy route is within a convergence tolerance to determine whether to identify additional efficient routes. The route determination control unit may weight the most efficient route, the modal route, and at least more of the efficient routes based on frequency of usage. In at least one embodiment, the route determination control unit predicts an amount of fuel needed and amount of payload that may be carried based on the efficient route(s).

Certain embodiments of the present disclosure provide an aircraft flight route determination method that includes analyzing, by a route determination control unit, route data over a selected timeframe, and determining, via the analyzing, one or more efficient routes for aircraft to fly between a first airport and a second airport.

The aircraft flight route determination method may also include analyzing, by the route determination control unit, weather data over the selected timeframe to determine the one or more efficient routes.

The analyzing may include identifying archived winds for days within the selected timeframe. In at least one embodiment, the determining includes determining an efficient route for each day within the selected timeframe, selecting a modal route (wherein the modal route is the route that has been flown the most during the selected timeframe), and determining a most efficient route among the efficient routes for each day within the selected timeframe. In at least one embodiment, the determining includes comparing the most efficient route with the efficient routes, identifying a largest efficiency difference in relation to the most efficient route as a largest discrepancy route, and determining whether the largest discrepancy route is within a convergence tolerance to determine whether to identify additional efficient routes. The aircraft flight route determination method may also include weighting, by the route determination control unit, the most efficient route, the modal route, and at least more of the efficient routes based on frequency of usage. In at least one embodiment, the aircraft flight route determination method also includes predicting, by the route determination control unit, an amount of fuel needed and amount of payload that may be carried based on the efficient route(s).

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide aircraft flight route determination systems and methods that may predict payload that may be carried by an aircraft, and an amount of fuel needed to carry the payload on a given city-pair with a given aircraft definition (airframe, engine, and empty weight) for a given date range in a year. In at least one embodiment, the aircraft flight route determination systems and methods may be used to form a set of fixed routes for an airline constrained to flying fixed routes, such that on any given day one of the fixed routes advantageously is close to a wind-adapted route. The aircraft flight route determination systems and methods may use actual discrete worldwide wind and temperature distributions, calculate the fuel and payload for each, and thereby create a distribution of fuel and payload that is consistent with the physics of wind and temperature.

Certain embodiments of the present disclosure provide systems and methods that are configured to improve flight routes for an airline, selecting an improved defined route for a given day of operation.

Figure 1:
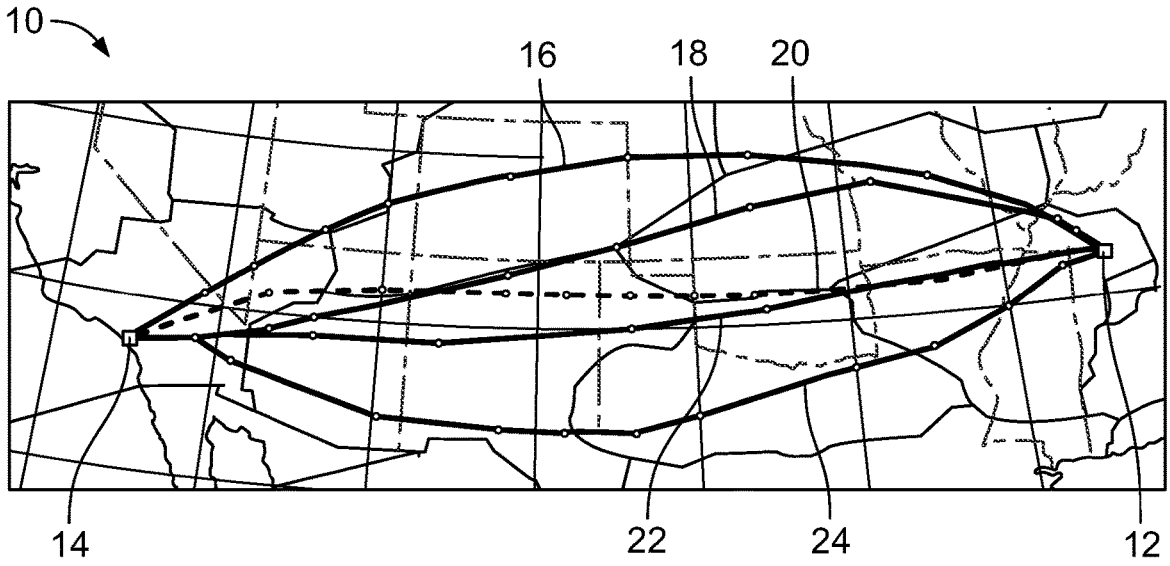
FIG. 1 illustrates a map showing a plurality of routes for an aircraft between a first airport and a second airport.

FIG. 1 illustrates a map showing a plurality of flight routes 10 for an aircraft between a first airport 12 and a second airport 14. For example, for a given day, aircraft may fly a first route 16, a second route 18, a third route 20, a fourth route 22, and a fifth route 24 between the first airport 12 and the second airport 14. Due to changing weather conditions (including changing winds), pilots may opt for different routes during the day. While the third route 20 may be the most direct route between the first airport 12 and the second airport 14, changing wind conditions may cause the pilot to opt for one of the other routes 16, 18, 22, or 24, in order to reduce flying into a headwind, for example. In short, during any given day, aircraft operated by one or more airlines may fly between a city-pair (that is, the first airport 12 and the second airport 14) over different routes, such as the first route 16, the second route 18, the third route 20, the fourth route 22, and the fifth route 24.

While five different routes 16, 18, 20, 22, and 24 are shown, aircraft may fly between the city-pair over more or less routes than shown. For example, on a given day, aircraft may fly between the city-pair over twenty or more routes.

Figure 2:
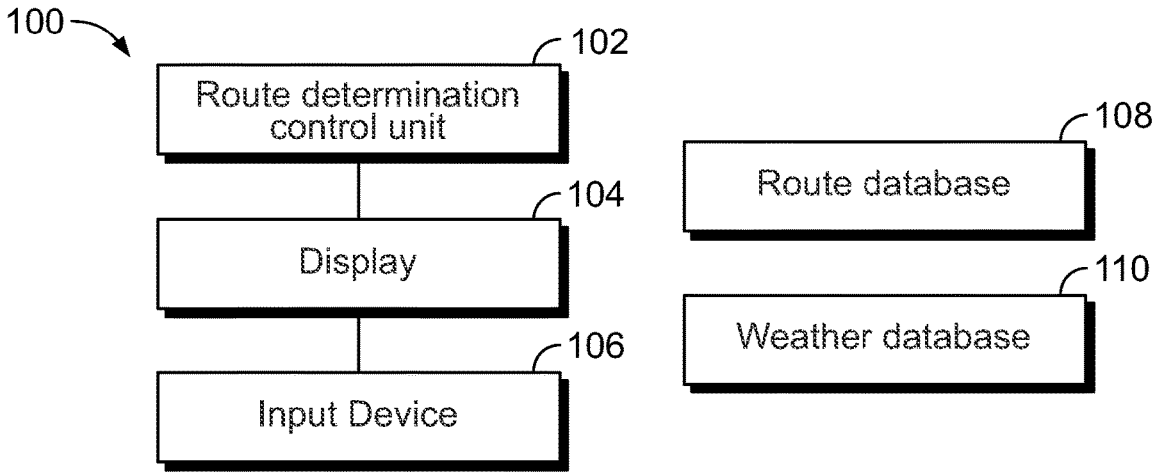
FIG. 2 is a schematic block diagram of an aircraft flight route determination system, according to an embodiment of the present disclosure.

FIG. 2 is a schematic block diagram of an aircraft flight route determination system 100, according to an embodiment of the present disclosure. The aircraft flight route determination system 100 includes a route determination control unit 102. In at least one embodiment, the route determination control unit 102 is in communication with a display 104 and an input device 106, such as through one or more wired or wireless connections. The route determination control unit 102, the display 104, and the input device 106 may be within a common housing, such as a computer, an aircraft computer, a handheld device, such as smart phone or table, and/or the like. In at least one other embodiment, the route determination control unit 102 is remotely located from the display 104 and the input device 106. For example, the route determination control unit 102 may be at a central location and in communication with a computing device that is remotely located from the central location.

The display 104 may be a monitor, television screen, touch screen interface, and/or the like. The input device 106 may be a keyboard, mouse, touch screen interface, stylus, and/or the like.

The route determination control unit 102 is in communication with a route database 108, such as through one or more wired or wireless connections. The route determination control unit 102 and the route database 108 may be collocated. Optionally, the route determination control unit 102 and the route database 108 may be remotely located from one another.

The route database 108 stores historical records of routes flown between different airports (as shown in FIG. 1) over a timeframe. For example, route data stored within the route database 108 includes the historical records of routes flown between a first airport and a second airport. The route database 108 may store routes flown between different airports for the past several days, weeks, months, or years.

In at least one embodiment, the route determination control unit 102 is also in communication with a weather database 110, such as through one or more wired or wireless connections. The route determination control unit 102 and the weather database 110 may be collocated. Optionally, the route determination control unit 102 and the weather database 110 may be remotely located from one another.

The weather database 110 stores historical records of weather (including historic wind data), such as between different airports over a timeframe. For example, the weather database 110 may store historical records of weather between different airports for the past several days, weeks, months, or years.

In at least one embodiment, the weather database 110 may store wind and temperature forecasts for past days (previous weather), as well as current, and future days (predicted weather). The weather database 110 may include such forecasts from one source or multiple sources. In at least one embodiment, the weather database 110 may store past and/or forecasted wind data, but not temperature data.

The weather database 110*t* stores the weather data including wind information. The route determination control unit 102 is in communication with the weather database 110 and may analyze the weather data (along with the route data) over the selected timeframe to determine one or more efficient routes for aircraft to fly between airports.

As described herein, the aircraft flight route determination system 100 includes the route determination control unit 102 that analyzes route data over a selected timeframe to determine one or more efficient routes for aircraft to fly between the first airport 12 and the second airport 14. The route data includes information regarding routes flown between the first airport 12 and the second airport 14. In at least one embodiment, the route data includes fuel burn and payload for aircraft that have flown routes between the first airport 12 and the second airport 14.

In operation, the route determination control unit 102 determines one or more efficient routes for aircraft to fly between the first airport 12 and the second airport 14 (shown in FIG. 1) based on an analysis of the routes stored in the route database 108, as described herein. The route determination control unit 102 may also determine the efficient routes based on an analysis of the historical records of weather stored in the weather database 110.

Figure 3:
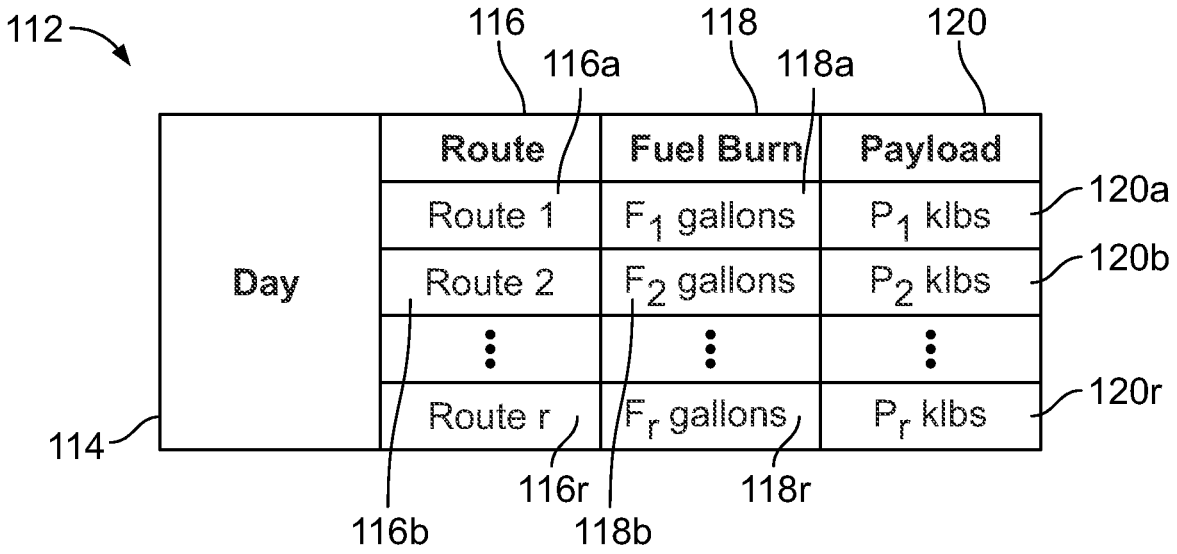
FIG. 3 illustrates a route table for a day, according to an embodiment of the present disclosure.

FIG. 3 illustrates a route table 112 for a day 114, according to an embodiment of the present disclosure. The route table 112 is an example of route data. The route table 112 for the day 114 may be stored in the route database 108, shown in FIG. 2. Each day 114 represents a past day that is stored in the route database 108. For each day 114, a plurality of routes 116 were flown between the first airport 12 and the second airport 14, shown in FIG. 1. For example, a first route 116*a*, a second route 116*b*, and a last route 116*r* were flown between the first airport 12 and the second airport 14. Numerous routes were flown between the first airport 12 and the second airport 14, such as three routes, four routes, twenty routes, thirty routes, or even more.

The routes 116 may be those flown by a single airline between the first airport 12 and the second airport 14. For example, airline ABC flew the routes 116*a*, 116*b*, . . . 116*r* between the first airport 12 and the second airport 14 on the day 114. In at least one other embodiment, the routes 116 may be those flown by two or more airlines between the first airport 12 and the second airport 14. For example, airline ABC and airline DEF combined to fly the routes 116*a*, 116*b*, and 116*r* between the first airport 12 and the second airport 14 on the day 114. In at least one other embodiment, the routes 116 may be those flown by all airlines between the first airport 12 and the second airport 14 on the day 114.

For each route 116*a*, 116*b*, . . . 116*r*, the route database 108 stores an amount of fuel burned (that is, fuel burn 118). That is, a first flight over the first route 116*a* has a particular fuel burn 118*a*, a second flight over the second route 116*b* has a particular fuel burn 118*b*, and a last flight over the last route 116*r* has a particular fuel burn 118*r*. Each fuel burn 118*a*, 118*b*, and 118*r* is generally different. For example, the aircraft that flew the first route 116*a* may have a lower fuel burn 118*a* than the fuel burn 118*b* of the aircraft that flew the second route 116*b*. In at least one embodiment, a lower fuel burn indicates a more efficient route. In at least one embodiment, additional variables such as direction of flight between airports, fuel efficiency differences between different types of aircraft, and/or the like may also be accounted for with respect to determining an efficient route (not just a lower fuel burn).

In at least one embodiment, for each route 116*a*, 116*b*, . . . 116*r*, the route database 108 stores a payload 120 (such as in klbs) for the aircraft that flew the particular route 116*a*, 116*b*, . . . 116*r*. That is, the first flight over the first route 116*a* carried a payload 120*a*, the second flight over the second route 116*b* carried a payload 120*b*, and the last flight over the last route 116*r* carried a payload 120*r*. Each payload 120*a*, 120*b*, and 120*r* may be different. For example, the aircraft that flew the first route 116*a* may have carried a heavier payload 120*a* than the payload 120*b* of the aircraft that flew the second route 116*b*. In at least one embodiment, an increased payload indicates a more efficient route. In at least one embodiment, additional variables such as direction of flight between airports, fuel efficiency differences between different types of aircraft, and/or the like may also be accounted for with respect to determining an efficient route (not just an increased payload).

Referring to FIGS. 2 and 3, in at least one embodiment, the route determination control unit 102 determines relative efficiency of the routes 116*a*, 116*b*, and 116*r* based on one or both of the respective fuel burns 118*a*, 118*b*, and 118*r*, and/or the respective payloads 120*a*, 120*b*, and 120*r*. For example, the route determination control unit 102 determines that a route having a first fuel burn is more efficient than another route having a second fuel burn that is greater than the first fuel burn (with all other things being equal). As another example, the route determination control unit 102 determines that a route having a first payload is more efficient that another route having a second payload that is less than the first payload (with all other things being equal). As another example, the route determination control unit 102 determines efficiency based on both fuel burn and payload. For example, a route having a combination of lowest fuel burn and highest payload is considered the most efficient (with all other things being equal). In at least one embodiment, different weights may be assigned to fuel burn or payload, depending on which an airline prefers to be a better indication of efficiency. For example, lower fuel burn may have an increased weighting than a higher payload.

Figure 4:
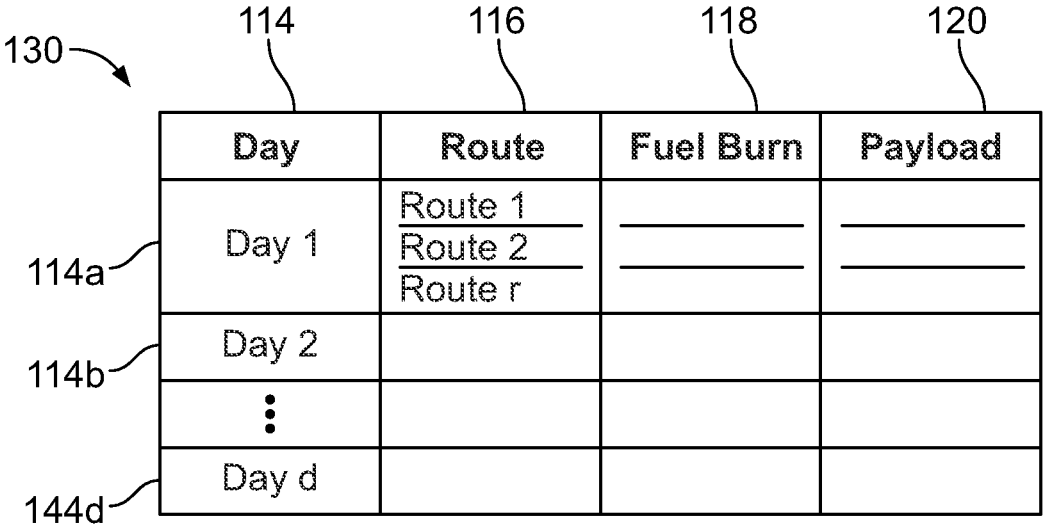
FIG. 4 illustrates a route table over a timeframe, according to an embodiment of the present disclosure.

FIG. 4 illustrates a route table 130 over a timeframe, according to an embodiment of the present disclosure. The route table 130 is an example of route data. The route table 130 includes a plurality of days. Each day 114 includes a plurality of routes 116, each of which is associated with a fuel burn 118 and a payload 120. Optionally, each route 116 may be associated with a fuel burn 118, but not a payload 120. In at least one other embodiment, each route 116 may be associated with a payload 120, but not a fuel burn 118. Data that forms the route table 130 is stored in the route database 108, shown in FIG. 2.

The timeframe for the route table 130 may be selected by an individual, such as through the input device 106 shown in FIG. 2. For example, the timeframe may be selected to be one week, one month, one year, one decade, or the like.

As noted, each day is associated with a plurality of routes flown between the first airport 12 and the second airport 14 (shown in FIG. 1). The number of routes for at least some of the days may be the same. For example, the number of routes flown between the first airport 12 and the second airport 14 on a first day 114*a* of the timeframe may be the same number of routes flown between the first airport 12 and the second airport 14 on a second day 114*b* of the timeframe. Further, the number of routes for at least some of the days may differ. For example, the number of routes flown between the first airport 12 and the second airport 14 on the last day 114*d* may differ from the number of routes flown between the first airport 12 and the second airport 14 on the first day 114*a*.

Referring to FIGS. 1-4, an individual first selects a desired timeframe that is to be used to determine one or more efficient routes between the first airport 12 and the second airport 14. As noted, the individual may use the input device 106 to select the desired timeframe. The route determination control unit 102 receives the desired timeframe input from the input device 106 and analyzes the route database 108 for associated route records over the selected timeframe, such as the route table 130 shown in FIG. 4.

In at least one embodiment, the individual may select a season of interest, which may include a month, a span of three or more months (such as up to six months), or any other timeframe of interest (such as ten years). The individual may select all years available, the most recent five years, or the like.

In at least one embodiment, a route table may include an optimized or improved route, which may include a series of geographical points between airports 12 and 14 for each day, and the fuel burn and payload for the route using the historical weather for that day. The route table may include a list of routes (in which each route includes a series of turn points between the airports 12 and 14) that provide a set of identified efficient routes between the airports 12 and 14. The routes may be historical routes that have already been flown, for example. For each day, a single route may be stored. The most efficient of the routes in a list of efficient routes for that day, along with its fuel burn and time may be provided. The most efficient route may be referred to as the best efficient route for each day.

Figure 5:
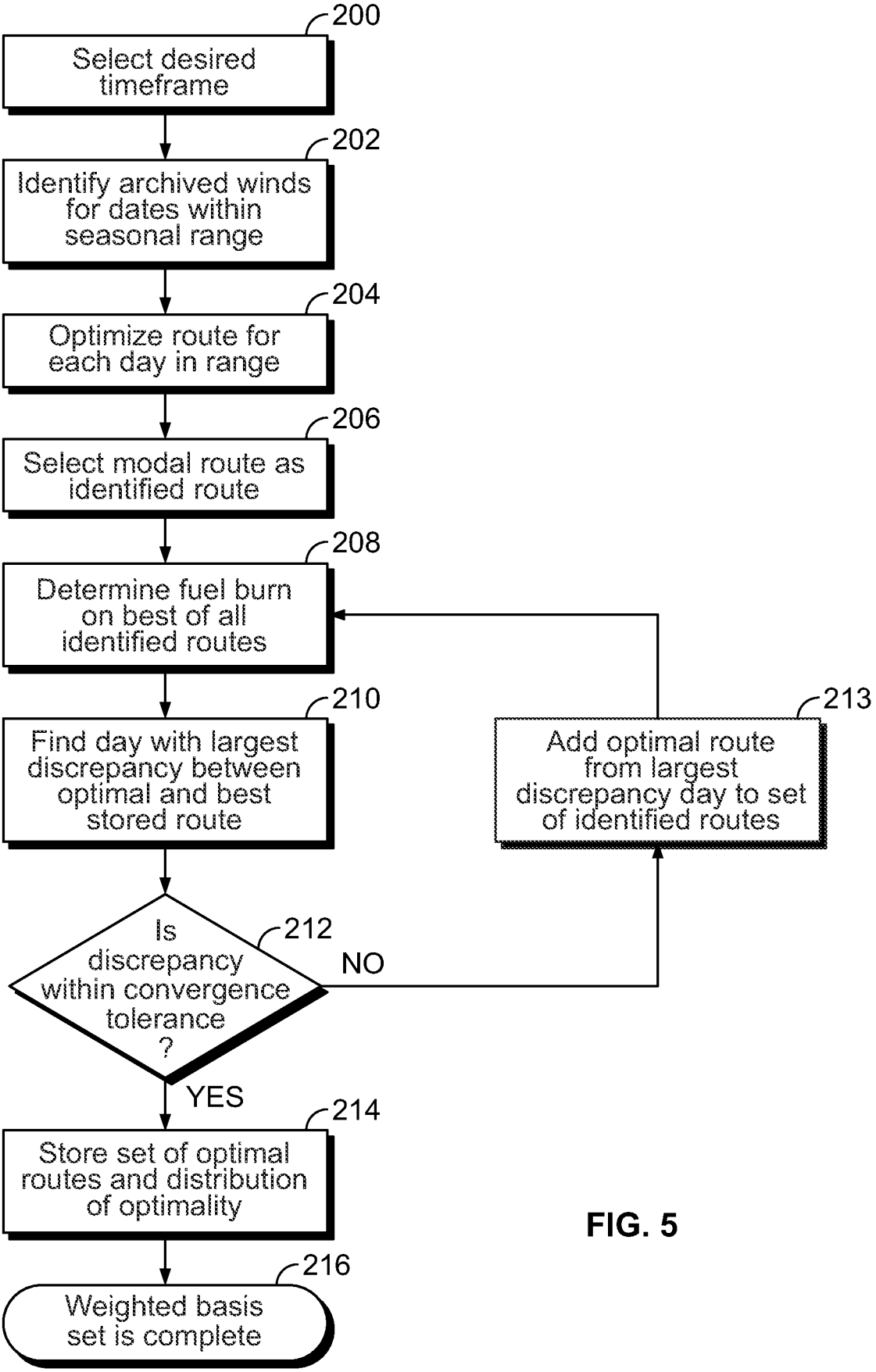
FIG. 5 illustrates a flow chart of an aircraft flight route determination method, according to an embodiment of the present disclosure.

FIG. 5 illustrates a flow chart of an aircraft flight route determination method, according to an embodiment of the present disclosure. Referring to FIGS. 1-5, at 200, a desired timeframe is selected for analysis. The desired timeframe may be one or more days, one or more weeks, one or more months, or one or more years. A longer timeframe may provide more accurate results due to the increased amount of data on which the analysis is based.

After the timeframe is selected, the route determination control unit 102 identifies archived winds for dates within a seasonal range, which may be the timeframe at 202 (or a portion thereof), such as stored in the weather database 110. For example, the timeframe selected may be for a future month of November. As such, the route determination control unit 102 may identify the archived winds for one or more previous Novembers that are stored within the weather database 110. In at least one embodiment, the route determination control unit 102 analyzes forecasted (that is, predicted for the future) winds (and optionally temperatures) as stored in the weather database 110 for a particular day.

Next, at 204, the route determination control unit 102 determines an optimized or improved route (that is, an efficient route) for each date within the range (such as the timeframe or a portion thereof), as stored in the route database 108. That is, the route determination control unit 102 analyzes the routes 116 (for example, uses any of a number of numerical methods to determine an efficient route, defined by a series of geographical points) for each day 114 within the selected timeframe and determines the most efficient route for each day 114. As described above, the route determination control unit 102 may determine the most efficient route 116 for each day 114 within the selected timeframe as the route 116 associated with the lowest fuel burn 118. In at least one other embodiment, the route determination control unit 102 may determine the most efficient route 116 for each day 114 within the selected timeframe as the route 116 associated with the greatest payload 120 (in terms of weight). In at least one other embodiment, the route determination control unit 102 may determine the most efficient route 116 for each day within the selected timeframe as the route 116 associated with the lowest fuel burn 118 and the greatest payload 120. As an example, if the selected timeframe is thirty days, each having twenty or more routes, the route determination control unit 102 determines the most efficient route for each of the thirty days, yielding a total of thirty determined efficient routes, each associated with a different day of the selected timeframe.

The efficient routes may include a lateral description of the path from the first airport 12 to the second airport 14 and an approximate model of the performance of the particular aircraft at different altitudes along the path of flight to account for vertical variation in wind and temperature in forecast of the particular day. Each day may have a single discrete optimal path, compliant with airspace use regulations in the geographical areas between the first airport 12 and the second airport 14. The efficient routes for each day may be stored in a memory (such as a database) of, or communicatively coupled to, the route determination control unit 102, along with the fuel and time to fly each efficient route.

After the route determination control unit 102 determines the efficient routes for each day within the selected timeframe, at 206, the route determination control unit 102 selects a modal route as a first identified route. In particular, the route determination control unit 102 analyzes the selected timeframe, as stored in the route database 108, to determine which route has been flown the most during the selected timeframe. For example, over a selected timeframe, one particular route may have been flown forty times, which is more than any other route. The route determination control unit 102 selects the most flown route during the selected timeframe as the modal route (that is, the first identified route).

In at least one embodiment, at 208, the route determination control unit 102 determines the fuel burn 118 on the most efficient of all the identified routes. That is, out of all of the efficient routes for the days within the selected timeframe, the route determination control unit 102 determines the most efficient of all of the efficient routes. For example, if the selected timeframe is thirty days, the route determination control unit 102 identifies thirty efficient routes, one for each day within the selected timeframe. Out of those thirty efficient routes, the route determination control unit 102 may identify the most efficient of the routes (for example, the route with the least amount of fuel burn 118). The route determination control unit 102 may identify this particular route on the particular day as the most efficient route.

In at least one other embodiment, at 208, the route determination control unit 102 determines the fuel burn on the most recently added of a set of efficient routes for each day within the selected timeframe, and compares it to the fuel burn 418 for the best efficient route yet found for that day. If it is lower (or there is not yet a value for that day), the most recently added efficient route is stored for that day. For example, if the selected timeframe is thirty days, the route determination control unit 102 makes thirty comparisons, one for each day within the selected timeframe.

In at least one embodiment, at 210, the route determination control unit 102 determines the day having the route, as identified in 202, with the largest discrepancy with the most efficient route, as determined at 208. For example, the route determination control unit 102 compares the most efficient route as determined at 208 with all of the efficient routes determined at 202. The route determination control unit 102 identifies the day 114 having the largest efficiency difference between the most efficient route. The route on such day 114 is identified as the largest discrepancy route. As such, the route determination control unit 102 compares the most efficient route with the efficient routes and identifies one of the efficient routes that has the largest efficiency difference in relation to the most efficient route as a largest discrepancy route.

In at least one other embodiment, at 210, the route determination control unit 102 determines the day having the route, as determined in 204 and stored in an Optimized or Improved Route Table, with the largest discrepancy with the most efficient route for that day, as determined at 208. The route determination control unit 102 identifies the day 114 having the largest efficiency difference between the most efficient route for that day and the optimized route for that day. The route on such day 114 is identified as the largest discrepancy route. As such, the route determination control unit 102 compares the most efficient route with the efficient routes and identifies one of the efficient routes that has the largest efficiency difference in relation to the most efficient route as a largest discrepancy route.

In at least one embodiment, at 212, the route determination control unit 102 then determines whether the largest discrepancy route is within a convergence tolerance. The convergence tolerance is predefined, such as by an individual or airline. If the largest discrepancy route is not within the convergence tolerance, the method proceeds to 213, at which the efficient route from the day of the largest discrepancy route is added to a set of identified routes, and the process returns to 208. For example, if the largest discrepancy route is too great, then additional most efficient routes are determined so as to form a set of most efficient routes, as the initial efficient route may have been skewed due to uncannily good weather, including winds.

In at least one other embodiment, at 212, the route determination control unit 102 determines whether the largest discrepancy route is within a convergence tolerance. The convergence tolerance is predefined, such as by an individual or airline. If the largest discrepancy route is not within the convergence tolerance, the method proceeds to 214, at which the efficient route from the day of the largest discrepancy route is added to a set of identified routes stored in an Efficient Routes Table, and the process returns to 208. For example, if the largest discrepancy route is too great, then additional most efficient routes are determined so as to form a set of most efficient routes, as the set of efficient routes determined so far may not contain one that is efficient to fly in the weather, including winds, on the day with the largest discrepancy.

If, however, the largest discrepancy route is within the convergence tolerance at 212, the method proceeds from 212 to 214, at which the most efficient route(s) as determined at 208 are stored in memory. As noted, a plurality of most efficient routes may be stored in memory, as described above if the discrepancy at 212 is too great. Thus, the route determination control unit 102 determines whether the largest discrepancy route is within a convergence tolerance to determine whether to identify additional efficient routes.

At 216, the route determination control unit 102 may optionally weight each of identified set of efficient routes. For example, the route determination control unit 102 may provide an increased weighting to the efficient routes, based on the number of times each route was flown during the selected timeframe. The route determination control unit 102 may weight the most efficient route, the modal route, and at least more of the efficient routes based on frequency of usage.

As described herein, the route determination control unit 102 determines route efficiency for aircraft flying between the first airport 12 and the second airport 14. The route determination control unit 102 determines the route efficiency by determining efficient routes 116 for each day 114 within a selected timeframe, and determining a most frequently flown route 116 within the selected timeframe. The most frequently flown route may be stored as an identified efficient route. The route determination control unit 102 determines the most efficient route out of all the identified efficient routes, including the most frequently flown route. As such, the route determination control unit 102 may have identified the most efficient route and the most frequently flown route as two identified efficient routes. The route determination control unit 102 then compares the most efficient route with the least efficient of all the identified efficient routes (that is, the identified efficient route flown having the greatest discrepancy with the most efficient route), and determines if the difference is within a predefined convergence tolerance. If not within the convergence tolerance, the route determination control unit 102 may then repeat the process to find a third identified efficient route.

As described herein, the route determination control unit 102 analyzes historic route data, as stored in the route database 108 (and weather data, as stored in the weather database 110) to determine one or more efficient routes for aircraft to fly between locations (for example, the first airport 12 and the second airport 14). In at least one embodiment, the route determination control unit 102 determines a set of efficient routes, each of which may be selected based on current weather conditions. The route determination control unit 102 may determine the set of efficient routes as a set of predetermined company routes that may be used by a particular airline as set routes between two different locations. For example, certain airlines may prefer a set of pre-defined routes between two airports instead of actively optimizing a route for each flight. For each flight, the pre-defined company routes are compared and the most favorable one is utilized, depending on current weather conditions.

Based on the identified set of efficient routes, the route determination control unit 102 may also predict an amount of fuel needed to fly to destinations and the amount of payload that may be carried during such flights. For example, the route determination control unit 102 may store the identified set of efficient routes. X may represent the set of efficient routes, with frequency distribution A, so that the routes taken over a time can be represented by a1x1+a2xx . . . anxn. The route determination control unit 102 may determine fuel burn and payload by applying specific aircraft, engine, and configuration capabilities to either actual winds from corresponding specific days or historical winds. In at least one embodiment, from the set X and frequency distribution A, the route determination control unit 102 may calculate a mean and probability distribution, for the city-pair in question (for example, the first airport 12 and the second airport 14) of the average (along the route of flight) headwind component (as stored in the weather database 110), the average (along the route of flight) temperature, (as stored in the weather database 110), and a ground distance between the first airport 12 and the second airport 14. The average headwind component and the ground distance may be combined into an equivalent still air distance, the miles flown taking into consideration wind, for a given air speed.

In at least one other embodiment, the route determination control unit 102, from the set X and frequency distribution A, may evaluate the fuel required and payload (for example, payload desired but unable to be flown by an aircraft) for a specific aircraft configuration and payload demand for each a1x1, and use such fuels and payloads to determine a mean and probability distribution for fuel and payload for the city-pair in question.

In at least one other embodiment, for the set X and frequency distribution A, the route determination control unit 102 may calculate a subset Y, frequency distribution B, and size m, so that an average and probability distribution of wind component of the sum b1y1+b2y2+ . . . bnyn matches those from the sum a1x1+a2xx . . . anxn to within a user-specified tolerance, where m<n. From the set Y and frequency distribution B, the route determination control unit 102 may calculate a mean and probability distribution, for the city-pair in question of the average (along the route of flight) headwind component, the average (along the route of flight) temperature, and the ground distance between the first airport 12 and the second airport 14, as described above.

As used herein, the term "control unit," "central processing unit," "unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the route determination control unit 102 may be or include one or more processors that are configured to control operation thereof, as described herein.

The route determination control unit 102 is configured to execute a set of instructions that are stored in one or more data storage units or elements (such as one or more memories), in order to process data. For example, the route determination control unit 102 may include or be coupled to one or more memories. The data storage units may also store data or other information as desired or needed. The data storage units may be in the form of an information source or a physical memory element within a processing machine.

The set of instructions may include various commands that instruct the route determination control unit 102 as a processing machine to perform specific operations such as the methods and processes of the various embodiments of the subject matter described herein. The set of instructions may be in the form of a software program. The software may be in various forms such as system software or application software. Further, the software may be in the form of a collection of separate programs, a program subset within a larger program or a portion of a program. The software may also include modular programming in the form of object-oriented programming. The processing of input data by the processing machine may be in response to user commands, or in response to results of previous processing, or in response to a request made by another processing machine.

The diagrams of embodiments herein may illustrate one or more control or processing units, such as the route determination control unit 102. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the route determination control unit 102 may represent processing circuitry such as one or more of a field programmable gate array (FPGA), application specific integrated circuit (ASIC), microprocessor(s), and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in a data storage unit (for example, one or more memories) for execution by a computer, including RAM memory, ROM memory, EPROM memory, EEPROM memory, and non-volatile RAM (NVRAM) memory. The above data storage unit types are exemplary only, and are thus not limiting as to the types of memory usable for storage of a computer program.

Figure 6:
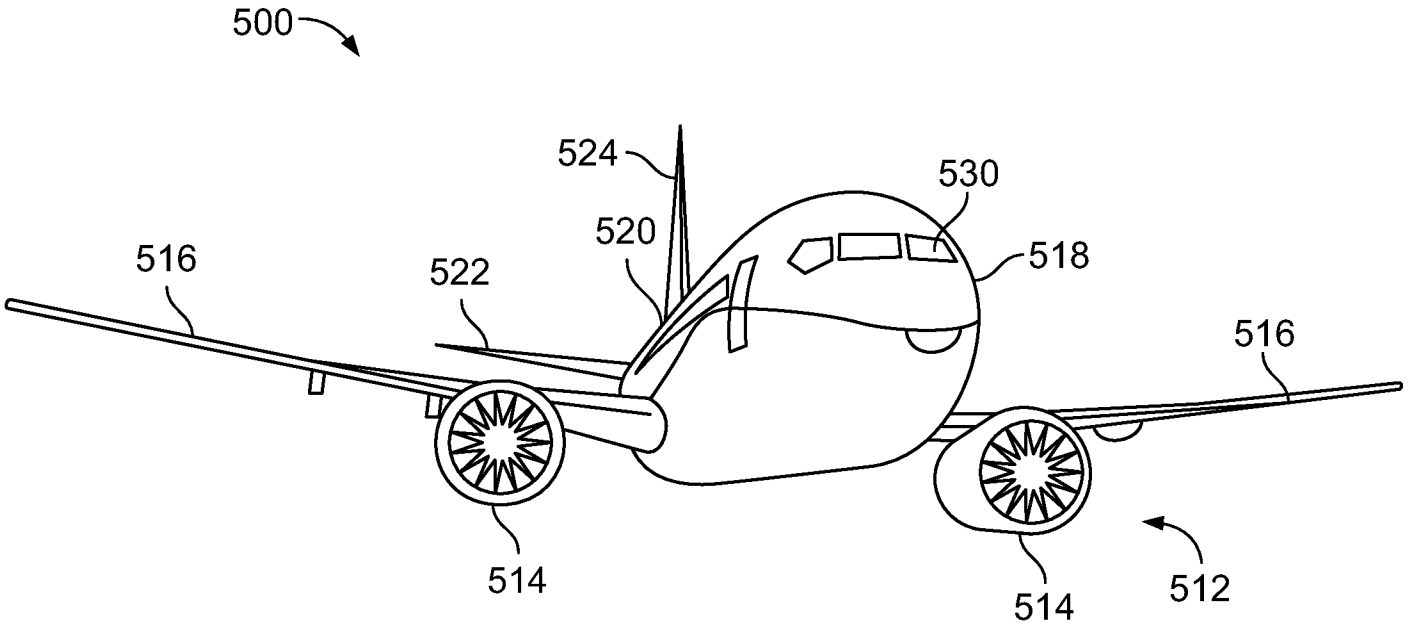
FIG. 6 is a diagrammatic representation of a front perspective view of an aircraft, according to an exemplary embodiment of the present disclosure.

FIG. 6 is a diagrammatic representation of a front perspective view of an aircraft 500, according to an exemplary embodiment of the present disclosure. The aircraft 500 includes a propulsion system 512 that may include two turbofan engines 514, for example. Optionally, the propulsion system 512 may include more engines 514 than shown. The engines 514 are carried by wings 516 of the aircraft 500. In other embodiments, the engines 514 may be carried by a fuselage 518 and/or an empennage 520. The empennage 520 may also support horizontal stabilizers 522 and a vertical stabilizer 524. The fuselage 518 of the aircraft 500 defines an internal cabin, which may include a cockpit 530. The aircraft 500 is flown via routes between different airports.

The aircraft 500 may be sized, shaped, and configured other than shown in FIG. 6. For example, the aircraft 500 may be a non-fixed wing aircraft, such as a helicopter. As another example, the aircraft 500 may be an unmanned aerial vehicle (UAV).

Referring to FIGS. 1-6, embodiments of the present disclosure provide systems and methods that allow large amounts of data to be quickly and efficiently analyzed by a computing device. For example, numerous aircraft 500 may be scheduled to fly between different airports on any given day. Historical records may indicate tens of thousands of different routes over a selected timeframe. As such, large amounts of data are being tracked and analyzed. The vast amounts of data are efficiently organized and/or analyzed by the route determination control unit 102, as described herein. The route determination control unit 102 analyzes the data in a relatively short time in order to quickly and efficiently output and/or display efficient routes. A human being would be incapable of efficiently analyzing such vast amounts of data in such a short time. As such, embodiments of the present disclosure provide increased and efficient functionality with respect to prior computing systems, and vastly superior performance in relation to a human being analyzing the vast amounts of data. In short, embodiments of the present disclosure provide systems and methods that analyze thousands, if not millions, of calculations and computations that a human being is incapable of efficiently, effectively and accurately managing.

As described herein, embodiments of the present disclosure provide systems and methods for determining efficient routes for an aircraft to fly to a destination on any given day.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. An aircraft flight route determination system, comprising:

a route determination control unit including one or more processors, wherein the route determination control unit analyzes route data for routes over a selected timeframe to determine one or more efficient routes for aircraft to fly between a first airport and a second airport; and a display in communication with the route determination control unit, wherein the route determination control unit electronically shows the one or more efficient routes on the display.

2. The aircraft flight route determination system of claim 1, further comprising a route database that stores the route data, wherein the route determination control unit is in communication with the route database.

3. The aircraft flight route determination system of claim 1, wherein the route data comprises historical records of the routes flown between the first airport and the second airport.

4. The aircraft flight route determination system of claim 1, further comprising a weather database that stores weather data including wind information, wherein the route determination control unit is in communication with the weather database and analyzes the weather data over the selected timeframe to determine the one or more efficient routes.

5. The aircraft flight route determination system of claim 1, wherein the route data includes fuel burn and payload for aircraft that have flown between the first airport and the second airport.

6. The aircraft flight route determination system of claim 1, wherein the route data relates to a single airline.

7. The aircraft flight route determination system of claim 1, wherein the route data relates to a plurality of airlines.

8. The aircraft flight route determination system of claim 1, wherein the route determination control unit determines the one or more efficient routes based on analysis of fuel burn of the route data.

9. The aircraft flight route determination system of claim 1, wherein the route determination control unit determines the one or more efficient routes based on analysis of payload of the route data.

10. The aircraft flight route determination system of claim 1, wherein the route determination control unit determines the one or more efficient routes based on analysis of fuel burn and payload of the route data.

11. The aircraft flight route determination system of claim 1, wherein the route determination control unit identifies archived winds for days within the selected timeframe.

12. The aircraft flight route determination system of claim 1, wherein the route determination control unit determines an efficient route for each day within the selected timeframe.

13. The aircraft flight route determination system of claim 12, wherein the route determination control unit selects a modal route, wherein the modal route is the route that has been flown the most during the selected timeframe.

14. The aircraft flight route determination system of claim 13, wherein the route determination control unit determines a most efficient route among the efficient routes for each day within the selected timeframe.

15. The aircraft flight route determination system of claim 14, wherein the route determination control unit compares the most efficient route with the efficient routes and identifies a largest efficiency difference in relation to the most efficient route or day as a largest discrepancy route or day that is added to a set of efficient routes.

16. The aircraft flight route determination system of claim 15, wherein the route determination control unit determines whether the largest discrepancy route is within a convergence tolerance to determine whether to identify additional efficient routes.

17. The aircraft flight route determination system of claim 15, wherein the route determination control unit weights the most efficient route, the modal route, and at least more of the efficient routes based on frequency of usage.

18. The aircraft flight route determination system of claim 1, wherein the route determination control unit predicts an amount of fuel needed and amount of payload that may be carried based on the one or more efficient routes.

19. An aircraft flight route determination method, comprising:

analyzing, by a route determination control unit including one or more processors, route data for routes over a selected timeframe;

determining, via the analyzing, one or more efficient routes for aircraft to fly between a first airport and a second airport; and transmitting, by the route determination control unit to a display in communication with the route determination control unit, the one or more efficient routes.

20. The aircraft flight route determination method of claim 19, further comprising analyzing, by the route determination control unit, weather data over the selected timeframe to determine the one or more efficient routes.

* * * * *